United States Patent [19]

v. Schwerdtner

[11] 4,144,907

[45] Mar. 20, 1979

[54] DEVICE FOR STABILIZING FLOW THROUGH RADIAL BORES IN ROTATING HOLLOW CYLINDERS, ESPECIALLY HOLLOW SHAFTS OF GAS TURBINES

[75] Inventor: Otto A. v. Schwerdtner, Mülheim, Fed. Rep. of Germany

[73] Assignee: Kraftwerk Union Aktiengesellschaft, Mülheim, Fed. Rep. of Germany

[21] Appl. No.: 777,562

[22] Filed: Mar. 14, 1977

[30] Foreign Application Priority Data

Mar. 15, 1976 [DE] Fed. Rep. of Germany ..... 2610783

[51] Int. Cl.[2] ..... F15D 1/02; F15D 1/08

[52] U.S. Cl. ..... 138/39; 138/37; 138/114; 415/116

[58] Field of Search ..... 138/37, 39, 43, 114; 415/115, 116, 117

[56] References Cited

U.S. PATENT DOCUMENTS

| | | | |
|---|---|---|---|
| 2,552,239 | 5/1951 | Warren | 415/116 X |
| 2,632,626 | 3/1953 | McClintock | 415/116 |
| 2,858,101 | 10/1958 | Alford | 415/116 |
| 3,551,068 | 12/1970 | Scalzo et al. | 415/116 |
| 3,989,410 | 11/1976 | Ferrari | 415/116 X |
| 4,008,977 | 2/1977 | Brown et al. | 415/116 X |

*Primary Examiner*—Richard E. Aegerter
*Assistant Examiner*—James E. Bryant, III
*Attorney, Agent, or Firm*—Herbert L. Lerner

[57] ABSTRACT

Device for stabilizing flow through radial bores formed in a hollow rotation cylinder wherein a gaseous medium passes from a stationary chamber surrounding the hollow rotating cylinder through nozzle-like openings formed in a wall of the hollow rotating cylinder into the interior of the latter, includes a stationary ring disposed in the stationary chamber surrounding the hollow rotating cylinder, the stationary ring partly covering the openings formed in the wall of the hollow rotating cylinder.

3 Claims, 4 Drawing Figures

DEVICE FOR STABILIZING FLOW THROUGH RADIAL BORES IN ROTATING HOLLOW CYLINDERS, ESPECIALLY HOLLOW SHAFTS OF GAS TURBINES

The invention relates to a device for stabilizing flow hrough radial bores formed in hollow rotating cylinders, especially in hollow shafts of gas turbines, wherein a gaseous medium passes out of a stationary chamber through nozzle-shaped openings formed in a wall of the respective hollow rotating cylinders into the interior of the latter.

Such a device has become known heretofore for use with a gas turbine, from German Published Non-Prosecuted Application DT-OS No. 2 047 648. According to the latter application, for example, cooling air, from a stationary chamber surrounding the gas turbine, is advanced through radial bores in the shaft in axial cooling-gas channels within the shaft.

In order then to achieve a most optimal and loss-free transfer of the flow from the stationary to the rotating part, the radial bores are accordingly given a nozzle-like construction and is provided with corresponding guidance devices.

These guidance devices and nozzle inserts of the aformentioned heretofore-known published German application must, however, be accurately adjusted or coordinated beforehand, in the dimensions thereof, to the probable gas throughput, during the construction of the machine. If differences in the throughput quantity or the flow rate therethrough and, accordingly, flow instabilities are produced during the operation, a subsequent match is possible only with great difficulty, for the most part.

It is accordingly an object of the invention to provide a device for stabilizing flow through radial bores formed in a hollow rotating cylinder wherein the flow is stabilized by means of such radial bores, and by means of which, also subsequently, a simple match to occuring throughput or flow variations is possible.

It is accordingly an object of the invention to provide a device for stabilizing flow through radial bores formed in a hollow rotating cylinder wherein a gaseous medium passes from a stationary chamber surrounding the hollow rotating cylinder through nozzle-like openings formed in a wall of the hollow rotation cylinder into the interior of the latter. The device comprises a stationary ring disposed in the stationary chamber surrounding the hollow rotating cylinder, the stationary ring partly covering the openings formed in the wall of the hollow rotating cylinder. A part of the free cross section of the radial bores is thereby covered so that an increased flow velocity within these bores is thereby attainable.

In accordance with another feature of the invention, the ring is disposed in the stationary chamber so as to cover a side of the openings that is farther away than the other side of the openings from a supply inlet opening for the gaseous medium to the stationary chamber.

In accordance with a further feature of the invention, the stationary ring is of disc-like construction and is disposed in a plane perpendicular to the wall of the rotating hollow cylinder, the disc-like ring being formed with a sealing point at the inner periphery thereof.

In accordance with a concomitant feature of the invention, the stationary ring is formed with a cylindrical projection at the inner periphery thereof, the cylindrical projection extending in axial direction of the rotating hollow cylinder and being formed at the inner surface thereof with a plurality of sealing points.

Other features which are considered as characteristic for the invention are set forth in the appended claims.

Although the invention is illustrated and described herein as embodied in device for stabilizing flow through radial bores in rotating hollow cylinders, especially hollow shafts of gas turbines, it is nevertheless not intended to be limited to the details shown, since various modifications and structural changes may be made therein without departing from the spirit of the invention and within the scope and range of equivalents of the claims.

The construction and method of operating of the invention, however, together with additional objects and advantages thereof will be best understood from the following description of specific embodiments when read in connection with the accompanying drawings, in which.

Figure 1:
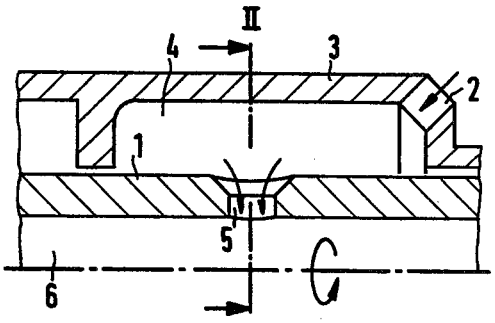
Fig.1 PRIOR ART
FIGS. 1 and 2 are, respectively, a longitudinal sectional view of a rotating hollow cylinder with a stationary gas feed chamber of conventional construction, and a cross-sectional view of FIG. 1 taken along the line II—II in direction of the arrows, both of the figures serving to explain the flow relationships in radial bores formed in the rotating hollow cylinder.
Figure 2:
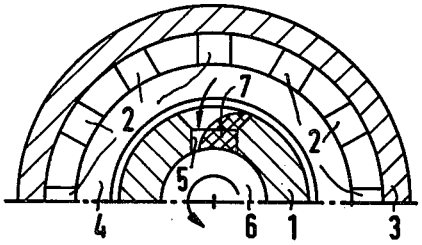
Fig.2 PRIOR ART

Many examples are found in the art wherein a gaseous medium of a static or steady-state system flows radially inwardly from the outside through a plurality of peripherally disposed radial bores of a rotating cylinder. Referring now to the drawing and first, particularly, to FIGS. 1 and 2 thereof, there is shown diagrammatically how a part of a flow of inflowing cooling air flows into the interior of a hollow shaft 1 of a gas turbine. The cooling air travels through bores 2 formed in a fixed housing 3 into an annular chamber 2 which surrounds the shaft 1. The flow possesses no significant peripheral component in this annular chamber 3. The gaseous medium i.e. the cooling air then flows out of the annular chamber 2 and through a plurality of radial bores 5 located at the periphery of the shaft 1 into the interior 6 of the hollow shaft 1.

Because of the peripheral speed of the rotating hollow cylinder 1, the on-flowing or afflux velocity has a peripheral component relative to the radial bore 5 directly at the inlet to the radial bore 5. In contrast thereto, the speed within the bore 5 has a predominantly radial component only if the ratio of the depth to the diameter of the bore 5 is sufficiently large. This means, theoretically, that the relative velocity within the bore 5 for reasons of continuity is lower than the relative on-flowing or afflux velocity toward the bore 5 directly forward or upstream of the bore 5. This delay of the velocity, depending upon the form of the bore 5, is possible only to a slight degree, and flow separations can result therefrom as indicated by the stippled field 7 in the section of the bore 5 shown in FIG. 2. The flow medium within the separated zone 7 is in a different equilibrium than is the main flow through the bore 5.

Due to the incident centrifugal forces, this medium tries to break through the inward flow again to the outside. This condition effects an unstable equilibrium in regions of relatively small volume flow or rate of flow through the bores 5, with reference to the peripheral speed in the bores 5. This can cause a pulsation of the flow, which manifests itself in that a wave of increased volume flow or increased flow rate, on the one hand, and a reduced or even negative volume flow or flow rate, on the other hand, springs from bore to bore at the periphery and, thus, circulates or revolves with a given frequence. This circulating or revolving wave is connected with a circulating or revolving pressure wave in the annular chamber 4, which signifies an excitation of oscillations and normally should be avoided.

This instability of the flow can be avoided by matching the sums of the cross sections of the radial bores 5 at the periphery thereof to the given volume flow or flow rate and the given pressure difference at the bores 5 between the annular chamber 4 and the interior 6 of the hollow shaft 1. Moreover, flow separation within the bores 5 is able to be avoided or reduced in accordance with the shape of the bores 5. These possibilities are employed also for a reconstruction of a gas turbine. However, a prediction regarding the unstable behavior remains unreliable. The necessity of a subsequent matching possibility often results, moreover, from changes in the operation of the machine as against the planning thereof. Subsequent matching of the bores per se often is possible, however, only through expensive replacement of machine parts combined with costly assembly or long shutdown time periods.

Figure 3:
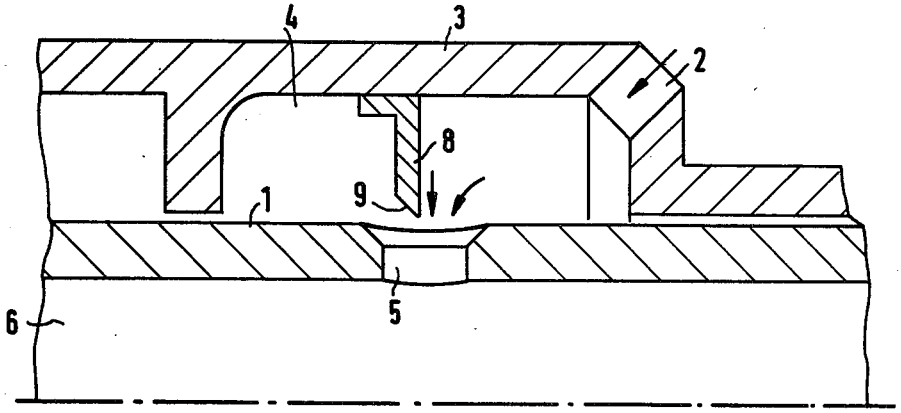
FIG. 3 is an enlarged view of FIG. 1 incorporating therein the device for stabilizing flow through the radial bores, in accordance with the invention, which comprises a ring of disc-like construction for partly covering the radial bores.

Subsequent or supplemental matching to avoid instabilities will be at low cost if the rotating parts and the bores per se remain unchanged. As is apparent from FIGS. 3 and 4, matching or conforming to the actual flow conditions is effected, in accordance with the invention, by covering respective parts of the bore 5. For this purpose, for example in FIG. 3, a ring 8 fastened to the stationary housing 3 is provided in the annular chamber 4, the inner periphery of the ring 8 being formed with a sealing point 9 opposite the rotating shaft 1 and ending above the radial bores 5. In this regard, it is necessary that the inlet opening 2 for the supplied gaseous medium into the annular chamber 4 is located on the uncovered side of the radial bores 5 so that a direct in-flow into these bores 5 is possible.

Figure 4:
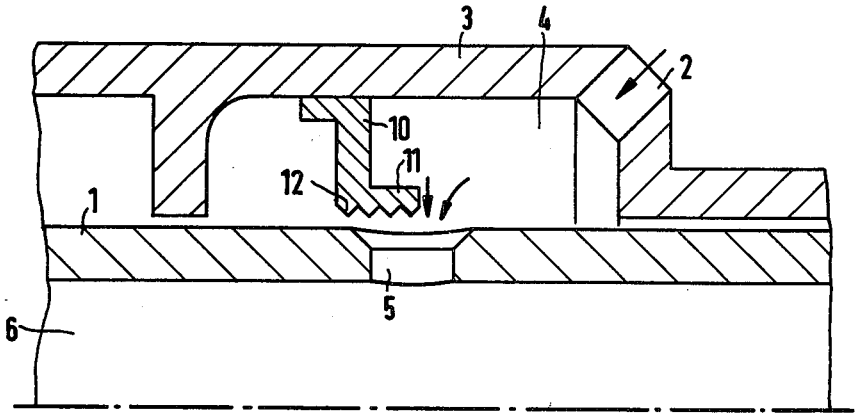
FIG. 4 is another view similar to that of FIG. 3 with another embodiment of the stabilizing device of the invention.

Another possible embodiment of the invention is shown in FIG. 4 wherein a ring 10 with a cylindrical projection 11 extending in axial direction is fastened to the stationary housing 3, the cylindrical projection 11 having a plurality of sealing points 12 on the inner side thereof. A part of the free in-flow cross section of the radial bores 5 is also covered thereby as in the embodiment of FIG. 3.

The effect of the covered part of the inlet cross section of the bores 5 in the embodiment of FIG. 4 is that the velocity in the remaining part of the inlet cross section is increased to such an extent, due to the constriction of the flow resulting from the covering of the part of the cross section by the projection points 12, that it is set, according to the order of magnitude, into an adequate ratio to the relative on-flowing or afflux velocity of the bores 5. Flow separations in the in-flow cross section of the bores 5 is thereby avoided, and subsequent separation zones that may possibly occur in the bores 5 are unable to break through the inlet cross section to the outside. Oscillations in the annular chamber 4 can thereby be prevented with reliability.

There are claimed:

1. Device for introducing gaseous cooling medium into the hollow shaft of a gas turbine from an annular stationary chamber surrounding said hollow shaft, comprising a housing for said annular stationary chamber including an outer cylindrical wall spaced from said hollow shaft and having a cooling medium inlet opening at one side thereof, said hollow shaft comprising a hollow rotating cylinder surrounded by said annular stationary chamber and having an inner cylindrical wall formed with nozzle-like radial openings for introducing a flow of the gaseous cooling medium received in said stationary chamber into the interior of said hollow rotating cylinder and means for stabilizing the flow of the gaseous cooling medium through said radial openings into the interior of said rotating cylinder, said stabilizing means comprising a stationary ring disposed in said stationary chamber and extending radially from said outer cylindrical wall of said housing to a location close to said hollow rotating cylinder in vicinity of said radial openings formed therein, said stationary ring partly covering said radial openings against the flow of gaseous medium flowing through said cooling medium inlet opening into said stationary chamber, part of said radial openings being exposed directly to said stationary chamber for communicating in radial direction therewith.

2. Device according to claim 1 wherein said stationary ring is of disc-like construction and is disposed in a plane perpendicular to the wall of the rotating hollow cylinder, said disc-like ring being formed with a sealing point at the inner periphery thereof.

3. Device according to claim 1 wherein said stationary ring is formed with a cylindrical projection at the inner periphery thereof, said cylindrical projection extending in axial direction of the rotating hollow cylinder and being formed at the inner surface thereof with a plurality of sealing points.

* * * * *